United States Patent [19]

Loyd

[11] Patent Number: 4,776,392

[45] Date of Patent: Oct. 11, 1988

[54] ELECTRICALLY GROUNDING OF NON-METALLIC PARTS

[75] Inventor: Lee R. Loyd, Peoria, Ill.

[73] Assignee: Caterpillar, Inc., Peoria, Ill.

[21] Appl. No.: 134,419

[22] Filed: Dec. 17, 1987

[51] Int. Cl.[4] ..... F24F 19/00

[52] U.S. Cl. ..... 165/134.1; 204/147

[58] Field of Search ..... 164/134.1; 204/147

[56] References Cited

U.S. PATENT DOCUMENTS

| | | | |
|---|---|---|---|
| 3,804,161 | 4/1974 | Nowak | 165/158 |
| 4,588,022 | 5/1986 | Sanz . | |
| 4,615,684 | 10/1986 | Kojima | 204/147 |

FOREIGN PATENT DOCUMENTS

| | | | |
|---|---|---|---|
| 889601 | 2/1962 | United Kingdom | 165/134.1 |

OTHER PUBLICATIONS

Publication: "Caterpillar Marine Engine Application and Installation Guide"—pp. 81 and 82; published Oct., 1982.

Reprint from Hydrocarbon Processing entitled, "Cathodic Protection Handbook" published in the Petroleum Refiner, vol. 36, No. 6—pp. 116–128; published Jun., 1957.

Publication: "Coating System and Steel Corrosion'-'—pp. 58–62; published in Modern Paint and Coatings; Apr., 1981; Author—Dean Berger, Gilbert/Commonwealth Associates, Inc., Reading, Pa.

*Primary Examiner*—Carroll B. Dority, Jr.

*Attorney, Agent, or Firm*—Larry G. Cain

[57] ABSTRACT

Sacrificial rods have been used in connection with shell and tube type heat exchangers to prevent corrosion of the cooling cores. These rods however have been employed with metallic heat exchanger components. The subject heat exchanger uses electrical non-conducting or plastic end covers which will not conduct a current flow. The end covers are provided with an electrical conducting metal sleeve, a metallic insert and an electrical conducting member which is connected in an electrical conducting relationship to the insert and at least one of the metallic sleeves. Thus, a grounded circuit is provided for the sacrificial rod. The reaction of the electrolyte and the rod prevents electrolytic damage to the core.

6 Claims, 2 Drawing Sheets

ELECTRICALLY GROUNDING OF NON-METALLIC PARTS

TECHNICAL FIELD

This invention relates generally to heat exchangers and more particularly to the prevention of electrolytic corrosion of a cooling core when exposed to an electrolyte.

BACKGROUND ART

Corrosion in heat exchangers has long been a problem. It is generally recognized that one of the causes of this deterioration is the electrolytic action between the dissimilar metals of the various components. This process, referred to as electrolysis, produces a flow of current between the two unlike metal areas when in the presence of an electrolyte, such as ionized water, which in turn causes corrosion on the more active metal (anode) and forms a protective coating on the less active metal (cathode).

There are a great many factors which control the rate of corrosion in this process, the most important being the relative positions of the metals in the electromotive series. This, of course, determines the electrical potential difference between the materials and thus controls the direction of the current flow. Other factors include water composition, flow velocity, temperature, area relationships of the "electrodes", flow restriction in the tubes, current density, and polarization which tends to insulate each "electrode" therefore decreasing the potential difference between the metals.

Naturally some metals or alloys withstand this type of corrosion better than others. However, more corrosion resistant materials are generally more expensive. This presents the problem of finding a compromise which will provide a unit with reasonable life at reasonable cost.

To increase life and reduce total cost, a "sacrificial" material is commonly used with heat exchangers prone to produce a current flow. Zinc, being very unstable as evidenced by its position in the galvanic series, is used as a "sacrificial" material in water systems to reduce the deterioration of the more expensive materials used in the highly dense structure of the shell and tube type heat exchangers.

Cost consideration has increased the use of plastic in heat exchangers. For example, U.S. Pat. No. 3,804,161 issued to Leon J. Nowak on Apr. 16, 1974 discloses one such heat exchanger. The utilization of plastic electrically insulating materials has made the problem of eliminating corrosion due to electrolytic action more difficult. For example, in the heat exchanger of Nowak, no current flow will occur from the metal anode tubes through the reinforced plastic heat exchanger to a grounded cathode. Thus, if used with an engine, the electrolytic action will occur between the core and the engine block. The metal of higher potential, the core, will become the anode. The core will tend to go into solution in the electrolyte and corrode. Thus, the life of the heat exchanger will be decreased.

The present invention is directed to overcoming one or more of the problems as set forth above.

DISCLOSURE OF THE INVENTION

In one aspect of the present invention a heat exchanger for preventing internal cooling core damage by electrolytic action is disclosed. The heat exchanger has a housing, a cooling core positioned in the housing and prone to produce a current flow when exposed to an electrolyte, at least one end cover, a grounded mounting bracket attached to the housing and means for connecting the housing and the cover. The heat exchanger comprises an end cover being of an electrical non-conducting material, a sacrificing rod removably attached to the cover and being in spaced relationship to the core and means for carrying the current flow from the rod to the bracket so that the current flow is transmitted away from the cooling core.

The invention as described above overcomes the tendency of the core to go into solution in the electrolyte when used in combination with plastic end covers. The sacrificing rod and the means for carrying the current flow from the rod to the grounded mounting bracket prevents electrolytic damage to the core increasing the life thereof.

BEST MODE FOR CARRYING OUT THE INVENTION

Figure 1:
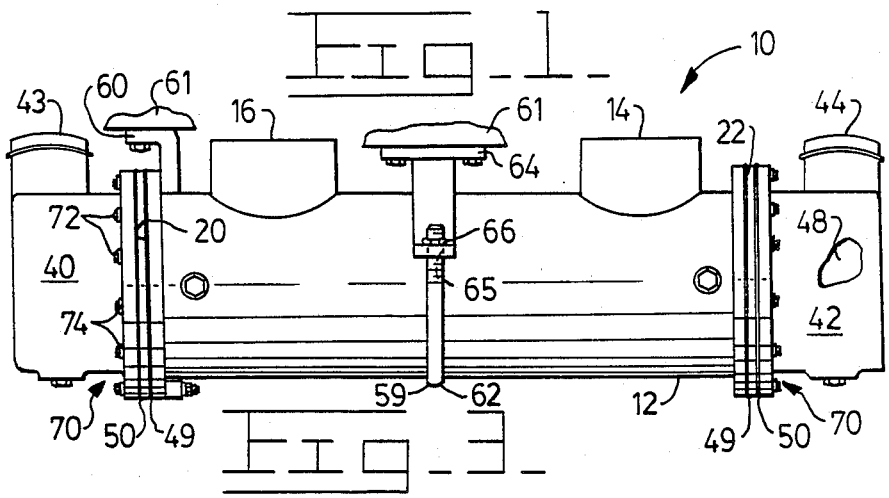
FIG. 1 is a top view of a single pass heat exchanger embodying the present invention.
Figure 3:
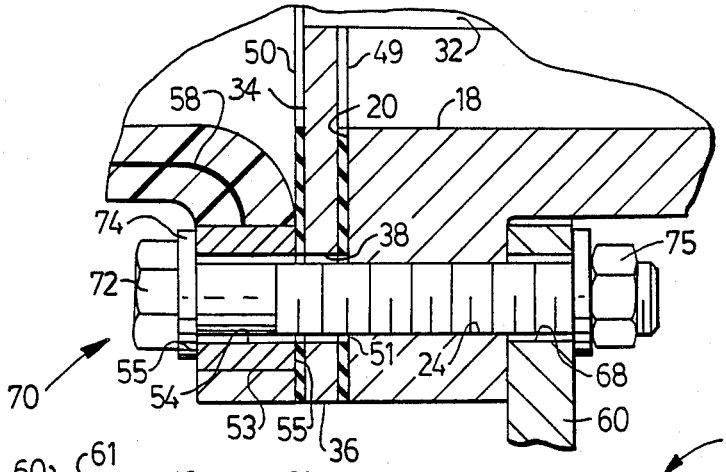
FIG. 3 is an enlarged partial sectional view taken through one of the sleeves.
Figure 2:
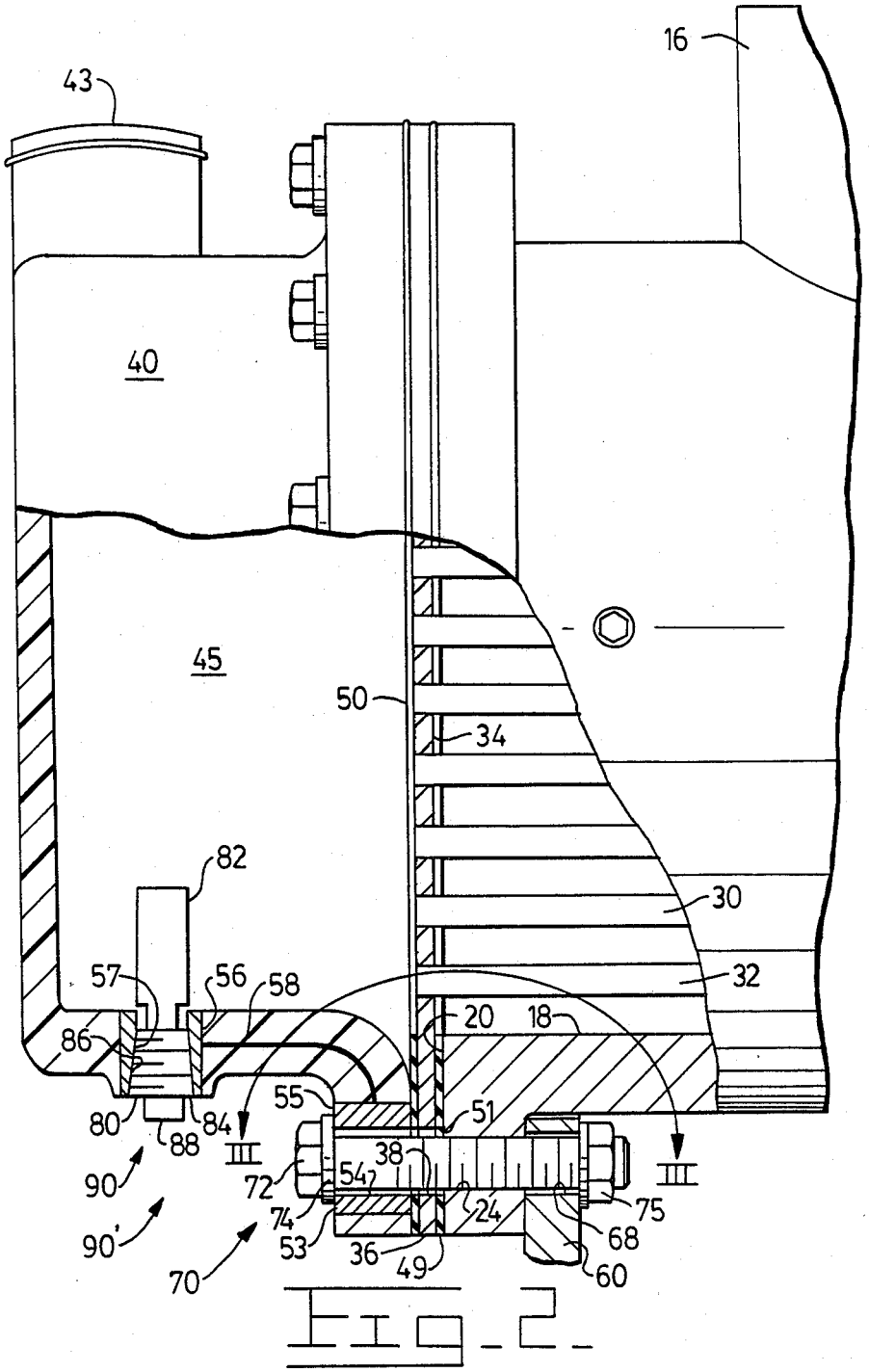
FIG. 2 is an enlarged partial sectional view of an end portion of the heat exchanger.

In reference to FIG. 1 a heat exchanger 10 includes a steel fabricated tank or housing 12 having an inlet 14 and an outlet 16 through which the liquid to be cooled can flow. As shown in FIGS. 1 and 2, the housing 12 includes an inner surface 18 and a pair of end surfaces 20,22. A plurality of threaded holes 24, one of which is shown in FIG. 3 at 24, is provided at the end surfaces 20,22 in the housing 12.

A cooling core 30 is constructed in a conventional manner an is positioned in the housing 12. The cooling core 30 includes a plurality of copper alloy tubes 32 held in spaced relation from the inner surface 18 by a pair of end sheets only one of which is shown at 34 and a plurality of baffles, not shown. At least one of the end sheets has a continuous flange 36 therearound. A plurality of holes 38 in the flange 36 corresponds to the plurality of threaded holes 24 in the housing 12; only one hole is shown. The end sheets 34 are in sealed relationship to the tubes 32.

Figure 4:
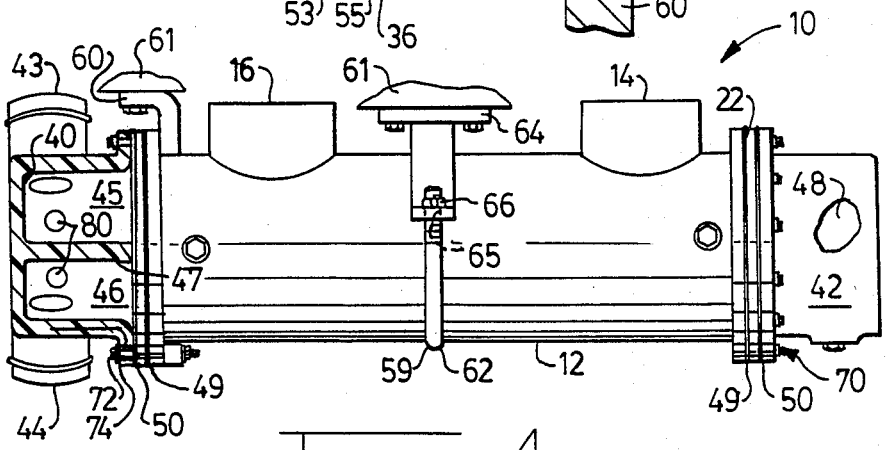
FIG. 4 is a partially sectioned view of a double pass heat exchanger embodying the present invention.

A pair of non-metallic electrical non-conducting end covers 40,42 are connected to the housing 12 at the end surfaces 20,22. The end covers 40,42 are constructed from any suitable one of a family of nylon resin plastics. The covers 40,42 in this embodiment are constructed from ZYTEL, a registered trademark of DuPont. A two pass cooler is shown in FIG. 4; in this embodiment the cover 40 has an inlet 43 and an outlet 44. A pair of chambers 45,46 are formed in the cover between the end sheet 34 and the cover 40. A partition 47 separates the chambers 45,46 within the cover. The cover 42 has a single chamber 48 formed therein between the cover 42 and the end sheet 34. A pair of gaskets 49,50 are positioned on each side of the flange 36 between the end surfaces 20,22 and the covers 40,42. The gaskets 49,50 have a plurality of holes therein of which only one is shown in FIG. 3 at 51. The plurality of holes 51 corresponds to the plurality of threaded holes 24 in the housing 12. Each of the covers 40,42 has a plurality of through holes 52 therein which correspond to the plurality of threaded holes 24 in the housing 12 and at least one electrical conducting metallic sleeve 53 therein. The sleeve 53 has a through hole 54 therein and a pair of ends 55 external of the covers. In this application two sleeves 53 are positioned in the cover 40 and a single sleeve 53 is positioned in cover 42 to correspond in location to corresponding ones of the plurality of threaded holes 24 in the housing 12. Each cover 40,42 has at least one electrical conducting metallic insert 56 therein. The insert 56 has a threaded hole 57 therein and is connected in an electrically conducting relationship to the sleeve 53 by an electrical conducting member 58 extending between the sleeve 53 and the insert 56. In this application the electrical conducting member 58 is brazed to the sleeve 53 and the insert 56. However, any appropriate method of insuring electrical conduction could be used. The conducting member 58 is integrally positioned within the covers and is electrically insulated by the nylon resin used to form each cover 40,42.

An alternative to the two pass cooler, a single pass cooler, is shown in FIG. 1. It is noted that the same reference numerals of the first embodiment are used to designate similarly constructed counterpart elements of this embodiment. In this embodiment, however, each of the covers 40,42 is constructed to have an inlet 43 and an outlet 44 respectively. A pair of chambers 45,48 are formed at opposite ends of the core 30 between the end sheets 34 and the covers 40,42. The remainder of the components and assembly remain identical.

First and second metallic brackets 59,60 are used to attach the heat exchanger 10 to an engine represented by partial section 61, as shown in FIG. 1, and provides a grounded connection for completing a circuit. The first bracket 59 includes a threaded U-bolt 62 straddling the housing 12 and a support member 64 connected to the engine to provide a grounded circuit. The member 64 has a pair of holes 65 through which the U-bolt 62 extends and a pair of nuts 66 threadably attached thereto. Thus, the housing 12 is grounded through the bracket to the engine. The second bracket 60 has at least one hole 68 therein which corresponds to one of the threaded holes 24 in the housing 12. The second bracket 60 is attached to the engine to provide a grounded circuit.

As best shown in FIG. 3, a means 70 for connecting each of the covers to the housing includes a plurality of bolts 72 having washers 74 thereon. At each end of the housing, the bolts 72 threadably engage the threaded holes 24 at the end surface 20 and connect the cover 40 to the housing. The bolts extend through the hole 54 in each of the sleeves 53 with the washers 74 contacting the end of the sleeves. At the other end of the housing the bolts 72 threadably engage the threaded holes 24 at the end surface 22 and connect the cover 42 and bracket 60 to the housing. The bolts extend through the hole 53 in the sleeve 54, through the threaded hole 24 and extend through the hole 68 in the second bracket 60 where a nut 75 is threaded thereon. Thus, the washer 74 contacts one end 55 of the sleeve 53 and is electrically connected to the second bracket 60. As an alternative, the washers 74 could be removed and the head of the bolt used to conduct the current flow.

A sacrificing rod 80 is removably attached to each of the covers 40,42 within each chamber 45,46,48 and is positioned in spaced relationship to the cooling core 30. The rod 80 has a zinc sacrificial material 82 attached to a brass plug 84. The plug 84 has an external thread 86 and a head 88 thereon. The thread 86 of the plug 84 is threadably attached to the threaded hole 57 in the metallic insert 56.

The insert 56, the conducting member 58, one of the sleeves 53, one of the plurality of bolts 72 and washers 74, and the housing 12 provide a means 90 for carrying the current flow from the rod 80 attached to the cover 40 to the first bracket 59. The insert 56, the conducting member 58 and one of the sleeves 53 provide a second means 90' for carrying the current from the rod 80 attached to the cover 42 to the bracket 60.

As a first alternative to the present combination of first and second brackets 59,60 as shown, a pair of the brackets 59 could be used with each of the brackets 59 being located near each end 20,22 of the housing 12. As a second alternative to the present combination of first and second brackets 59,60 as shown, a pair of brackets 60 could individually be used at each end cover 40,42 to attach to the sleeves 53 by the plurality of bolts 72.

INDUSTRIAL APPLICABILITY

The heat exchanger 10 of the present invention is used in conjunction with a marine engine. A fluid to be cooled, in this application engine coolant, is pumped by the engine coolant pump into the inlet 14 of the heat exchanger 10. The coolant to be cooled flows between the tubes 32, inside the inner surface 18 of the housing 12, between the end sheets 34 and returns to the engine through the outlet 16. Heat from the coolant is thermally transmitted to the tubes 32 and end sheets 34.

A cooling media, in this application sea water, is circulated by an external pump and enters the inlet 43 in the cover 40. In the two pass cooler the sea water flows through the chamber 45, the tubes 32, the chamber 48, the tubes 32, the chamber 46 and exits the outlet 44. The sea water which is cooler than the engine coolant absorbs heat from the tubes 32 and the end sheets 34 as it flows therethrough reducing the temperature of the engine coolant.

Galvanic corrosion or chemical attack between two dissimilar metals will normally occur in the presence of an electrolyte. In this case, the dissimilar metals are the copper alloy tubes 32 of the cooling core 30 and the steel fabricated housing 12 whereas the electrolyte is the sea water. Since the copper alloy has a higher potential than the steel fabricated housing 12, the tubes will become the anode and normally would tend to go into solution in the electrolyte, and therefore, corrode. However, the zinc anode sacrificing rod 80 which is very unstable and has a higher potential as evidenced by its position in the galvanic series, is positioned in the cover 40, thus the rod 80 corrodes reducing the deterioration of the copper alloy tubes 32 and extending the life of the tubes 32.

It has been found through experimentation that to insure proper operation of the sacrificing rod 80 a complete electric circuit must be provided. Therefore, the electrical non-conducting covers 40,42 are provided with a path through which electrical current created in the system can be transmitted away from the cooling core 30 preventing electrolytic damage thereof. To insure proper current flow from the sacrificing rods 80 in this embodiment, the flow is directed through two flow paths. The first path is from the rod 80 attached to the cover 40 through the metallic insert 56, the conducting member 58, one of the metallic sleeves 53, the washer 74, the bolt 72, the housing 12 and into the grounded first bracket 60. The second current flow path is from the rod 80 attached to the cover 42 through the metallic insert 56, the conducting member 58, one of the metallic sleeves 53 and into the grounded second bracket 60.

The primary advantage of the corrosion resistant system is its ability to use lighter, less expensive plastic material in the end covers and still provide a current flow path from the zinc sacrificial rod 80 away from the internal cooling core 30 preventing electrolytic damage thereto.

Other aspects, objects and advantages of this invention can be obtained from the study of the drawings, the disclosure and the appended claims.

I claim:

1. A heat exchanger having a housing, a cooling core positioned in the housing and being prone to produce a current flow when exposed to an electrolyte, at least one end cover, a grounded mounting bracket attached to the housing, and means for connecting the cover to the housing, comprising:

said end cover being of an electrical non-conducting material;

a sacrificial rod removably attached to said cover and being in spaced relationship to the core; and means for carrying the current flow from the rod to the bracket so that said current flow is transmitted away from the cooling core.

2. The heat exchanger of claim 1 wherein said means for carrying the current flow includes:

an electrical conducting member positioned in electrical conducting relationship between the sacrificial rod and the bracket.

3. The heat exchanger of claim 2 wherein said means for carrying the current flow includes:

at least one metallic sleeve positioned within the electrical non-conducting cover and having a through hole therein and a pair of ends external of the cover;

at least one metallic insert positioned within the electrical non-conducting cover and having a threaded hole therein, said rod being removably attached to the metallic insert; and an electrical conducting member positioned within the electrical non-conducting cover and connected to the metallic insert and at least one of the metallic sleeves.

4. The heat exchanger of claim 3 wherein said means for connecting the cover to the housing is in electrical conducting contact with the sleeve and the housing.

5. The heat exchanger of claim 3 wherein said bracket is in electrical conducting contact with the metallic sleeve in at least one of the end covers.

6. The heat exchanger of claim 3 wherein said bracket is in electrical conducting contact with the housing.

* * * * *